US009254244B2

(12) United States Patent
Perera et al.

(10) Patent No.: US 9,254,244 B2
(45) Date of Patent: Feb. 9, 2016

(54) ILLUMINATING BABY BOTTLE WITH REMOVABLE CONTAINER

(71) Applicants: Charith Shehan Perera, Gaithersburg, MD (US); Dilanika Sandra Sanders, Gaithersburg, MD (US); Sumedha Ishak Desilva, Elkridge, MD (US)

(72) Inventors: Charith Shehan Perera, Gaithersburg, MD (US); Dilanika Sandra Sanders, Gaithersburg, MD (US); Sumedha Ishak Desilva, Elkridge, MD (US)

( * ) Notice: Subject to any disclaimer, the term of this patent is extended or adjusted under 35 U.S.C. 154(b) by 96 days.

(21) Appl. No.: 14/309,654

(22) Filed: Jun. 19, 2014

(65) Prior Publication Data

US 2015/0366759 A1 Dec. 24, 2015

(51) Int. Cl.

| | |
|---|---|
| ***A61J 9/00*** | (2006.01) |
| ***F21V 23/04*** | (2006.01) |
| ***F21V 33/00*** | (2006.01) |
| ***F21L 4/00*** | (2006.01) |
| *F21Y 101/02* | (2006.01) |

(52) U.S. Cl.

CPC .. *A61J 9/008* (2013.01); *F21L 4/00* (2013.01); *F21V 23/04* (2013.01); *F21V 33/0024* (2013.01); *F21Y 2101/02* (2013.01)

(58) Field of Classification Search

CPC ..... A61J 9/00; F21V 33/0024; F21V 23/04; F21L 4/00

See application file for complete search history.

(56) References Cited

U.S. PATENT DOCUMENTS

| | | | | |
|---|---|---|---|---|
| 2007/0014100 | A1* | 1/2007 | Perez | A61J 9/00 362/101 |
| 2010/0072160 | A1* | 3/2010 | Hayes | A61J 9/008 215/11.1 |

* cited by examiner

*Primary Examiner* — David V Bruce

(57) ABSTRACT

An illuminating baby bottle with a removable container includes a first container, a second container, a release mechanism, a connecting member, a liquid-flowing system, a bottle cap, and a lighting device. The first container and the second container are axially attached to each other through the connecting member while the release mechanism is concentrically positioned in between the first container and the connecting member. The release mechanism selectively rotates in between a locked position and an unlocked position in such a way that the locked position separately stores baby formula and water while the unlocked position allows the mixing of baby formula and water. The liquid-flowing system releases baby formula mixture from the first container so that infants or young children can be fed with the baby formula mixture. The lighting device is positioned on the bottle cap and can selectively operate in between an on-position and an off-position.

20 Claims, 15 Drawing Sheets

SECTION B-B
SCALE 1 : 1

SECTION A-A
SCALE 1 : 1

ILLUMINATING BABY BOTTLE WITH REMOVABLE CONTAINER

FIELD OF THE INVENTION

The present invention relates generally to a baby bottle. More specifically, the present invention is an illuminating baby bottle that allows the users to separately store fluid material and food material while allowing the users to mix the fluid material and the food material together through a release mechanism.

BACKGROUND OF THE INVENTION

The baby bottle has through the history and gone through different variations so that the infants and young children are able to feed oneself or being fed when a mother is not breast-feeding. In particular, the baby bottle is used to feed baby formula, usually prepared by mixing water, so that the infants and young children are able to gain complete or partial substitute for human milk. In its basic form, the baby bottle is a bottle with a teat that is also known as the nipple. The bottle holds the liquid baby formula while the infants and young children are able to sucks the liquid baby formula through the teat. The modern baby bottles come in scores of styles, colors, and shapes so that the parents or the caregivers are able to choose one from a verity of different baby bottles. Most of the modern baby bottles are also engineered as leak-proof containers and cause less spitting up, burping, or gas to the infants and the young children. Even though the baby bottles provide an efficient and a safe method to feed the infants and young children, the baby bottle can be further improved to accommodate the efficiency of bottle feeding. One of the main problems with the modern baby bottle is that the parents or the caregivers usually have to carry a separate container so that the baby formula can be separately carried from the water as the water is stored within the baby bottle. Another problem with the modern baby bottle is that the baby bottle does not have a lighting device. More specifically, when the parents or the caregivers need to feed the infants or the young children during night time, the parents or the caregivers have to turn-on a light to locate the mouth of the infants or the young children. This often causes the infants or the young children to wake up from their sleep, resulting restless nights for the parents or the caregivers.

Therefore it is the object of the present invention to provide an illuminating baby bottle with a removable container. The removable container of the present invention allows the parents or the caregivers to store the baby formula within the present invention while the bottle portion allows them to store water. The baby formula and water are separated by a release mechanism of the present invention, where the release mechanism allows the parents or the caregivers to mix the baby formula and water within the baby bottle. The illuminating device of the present invention provides a lighting source for the present invention so that the parents or the caregivers are able to turn-on and turn-off the lighting source at their discretion.

DETAIL DESCRIPTIONS OF THE INVENTION

Figure 1:
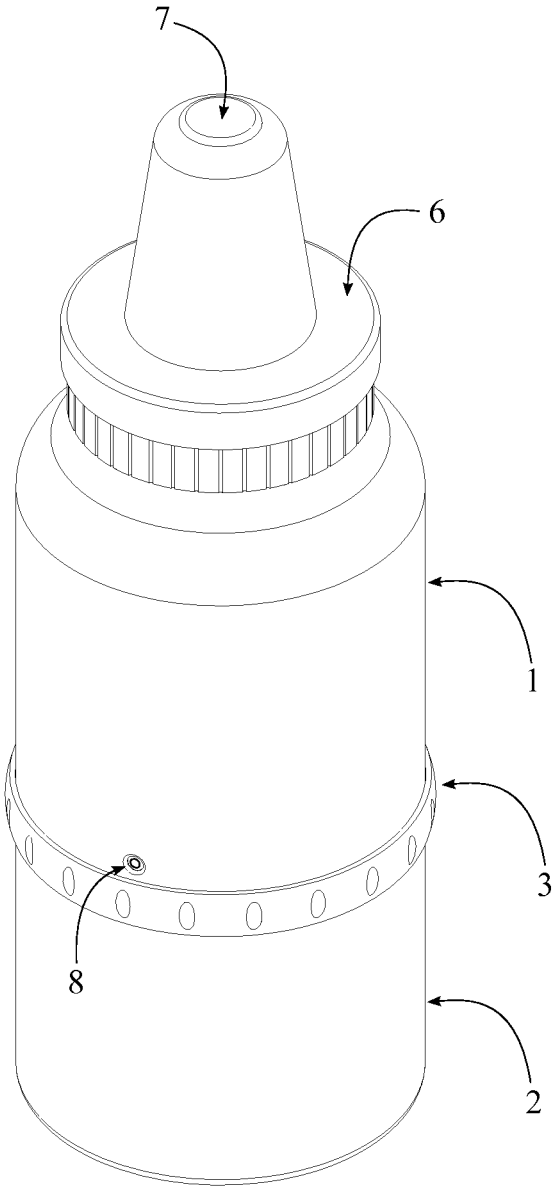
FIG. 1 is a top perspective view of the present invention.
Figure 2:
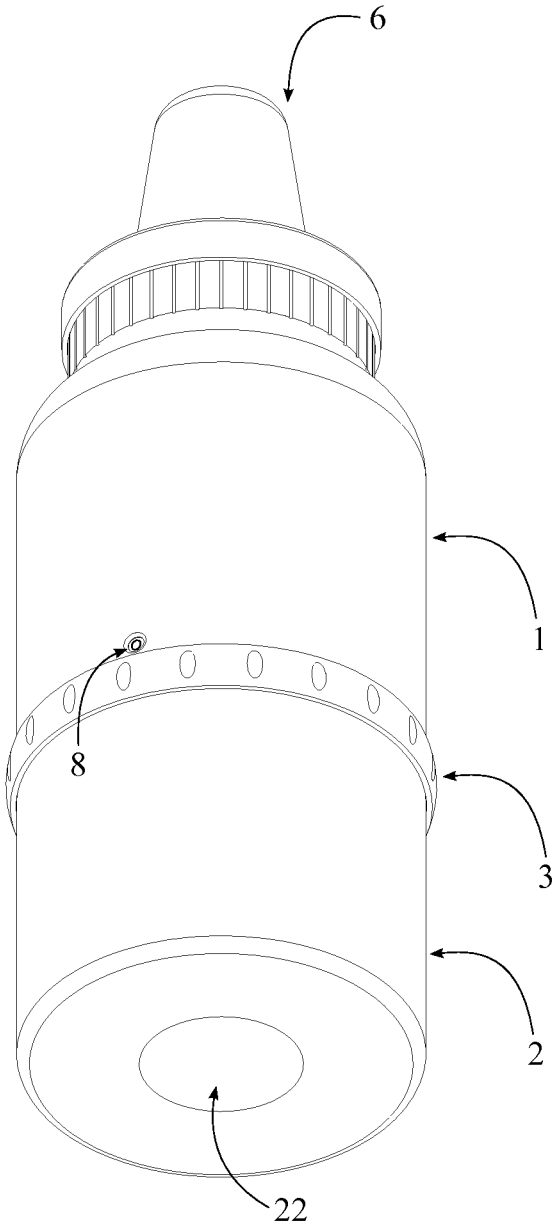
FIG. 2 is a bottom perspective view of the present invention.
Figure 3:
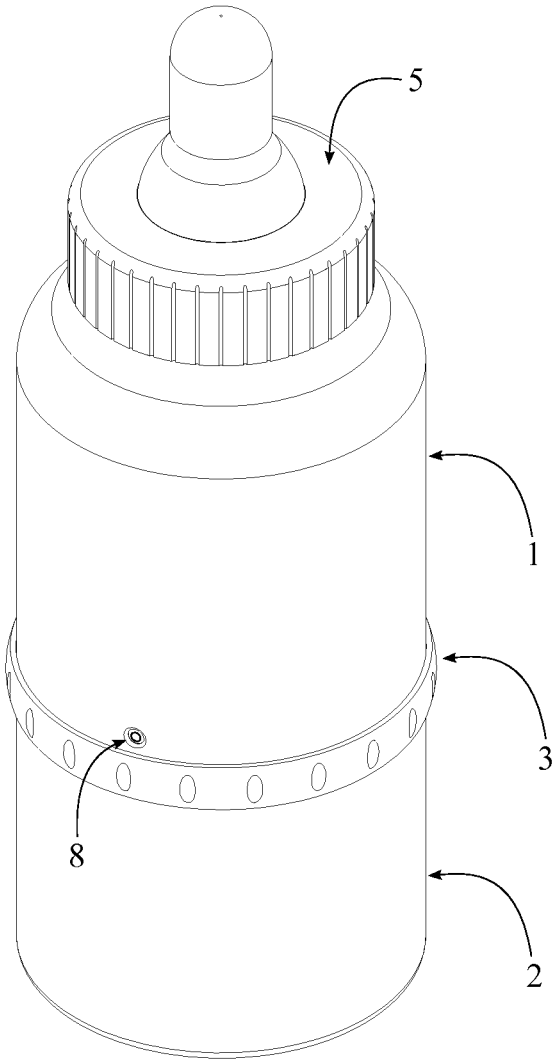
FIG. 3 is a top perspective view of the present invention without the bottle cap.

All illustrations of the drawings are for the purpose of describing selected versions of the present invention and are not intended to limit the scope of the present invention.

The present invention is an illuminating baby bottle with a removable container, where the present invention allows the users to separately store baby formula and water. Additionally, stored baby formula and water can be mixed together within the present invention so that the users can feed infants or young children by utilizing the present invention. All the components of the present invention are made from lightweight and high strength plastic materials that do not contain the chemical bisphenol A (BPA). In reference to FIG. 1-FIG. 7, the present invention comprises a first container 1, a second container 2, a release mechanism 3, a connecting member 4, a liquid-flowing system 5, a bottle cap 6, a lighting device 7, and a safety locking mechanism 8. In reference to the general configuration of the present invention, the first container 1 is axially attached with the second container 2 by the connecting member 4 in such a way that the release mechanism 3 is axially positioned in between the first container 1 and the connecting member 4. The release mechanism 3 selectively rotates in between a locked position and an unlocked position, where the locked position allows the present invention to separately store baby formula and water. However, when baby formula and water need to be mixed together within the present invention, the users need to switch the present invention from the locked position to the unlocked position. The liquid-flowing system 5 is axially attached with the first container 1 and oppositely positioned from the release mechanism 3. The lighting device 7 is connected atop the bottle cap 6, where the lighting device 7 selectively operates in between an on-position and an off-position. The bottle cap 6 can either attach around the liquid-flowing system 5 or with the second container 2, where the two different attachment configurations provide different functionality to the present invention.

Figure 9:
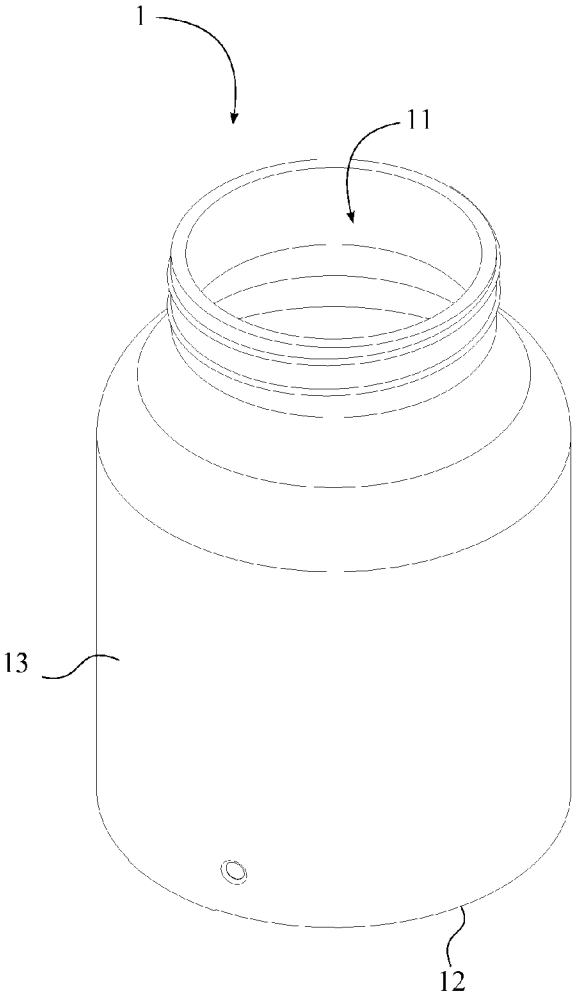
FIG. 9 is a top perspective view of the first container of the present invention.
Figure 8:
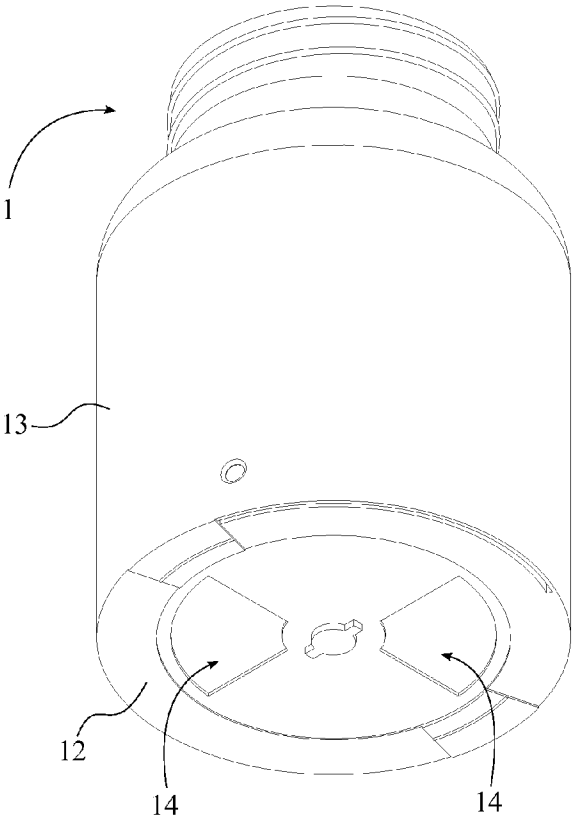
FIG. 8 is a bottom perspective view of the first container of the present invention.

In reference to FIG. 8 and FIG. 9, the first container 1, which generally stores water, comprises a top opening 11, a first-container base 12, a first lateral wall 13, and a plurality of first openings 14. The first lateral wall 13 is perimetrically connected around the first-container base 12, and the top opening 11 is oppositely positioned from the first-container base 12 along the first lateral wall 13. The top opening 11 provides a hole so that the inside of the first container 1 can be either filled with water or cleaned through the top opening 11. The top opening 11 is concentrically positioned with the first-container base 12, where the positioning of the top opening 1, the first-container base 12, and the first lateral wall 13 creates a cylindrical shape for the first container 1. The plurality of first openings 14 is traversed through the first-container base 12 and functions as access holes to the second container 2 through the release mechanism 3.

Figure 15:
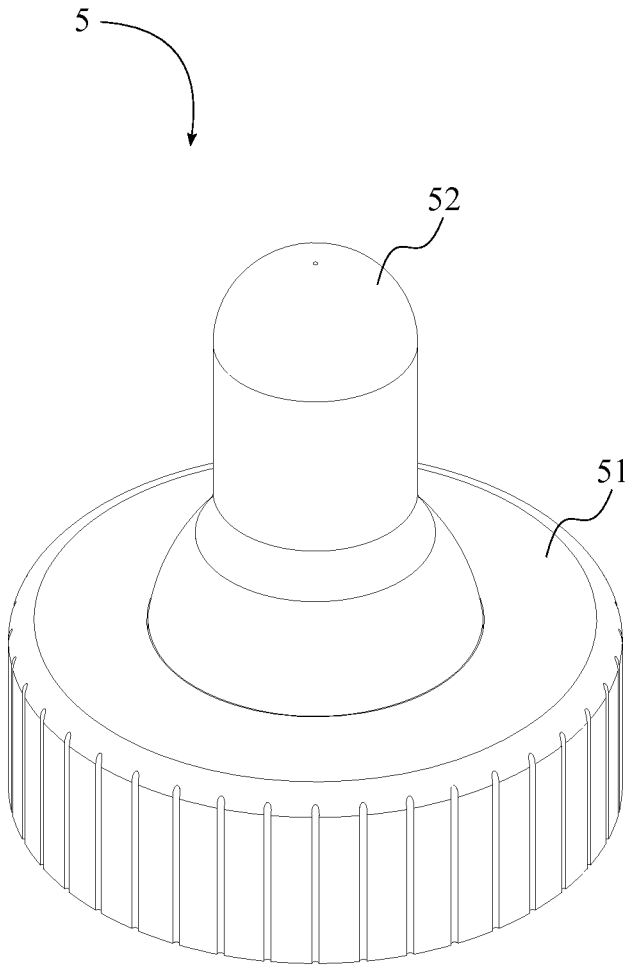
FIG. 15 is a perspective view of the liquid-flowing system of the present invention.

In reference to FIG. 15, the liquid-flowing system 5 that supplies baby formula mixture from the first container 1 to the mouth of the infants or the young children comprises a nipple collar ring 51 and a flexible nipple 52; however, the liquid-flowing system 5 may also include additional components to reduce spitting up, burping, or gas. The nipple collar ring 51 is adjacently and concentrically attached around the flexible nipple 52 so that the nipple collar ring 51 is able to concentrically attach around the top opening 11. Additionally, the nipple collar ring 51 provides a leak free attachment between the liquid-flowing system 5 and the first container 1.

Figure 11:
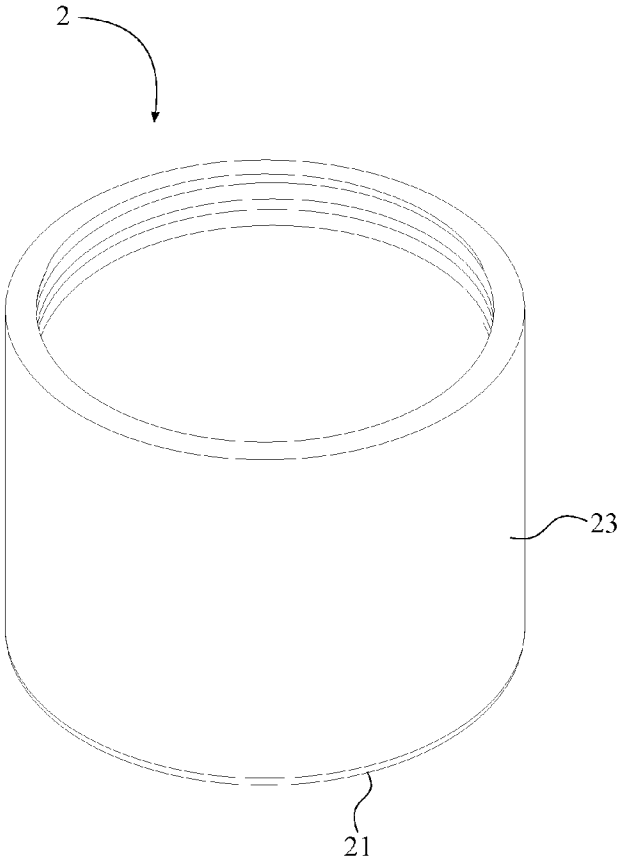
FIG. 11 is a top perspective view of the second container of the present invention.
Figure 10:
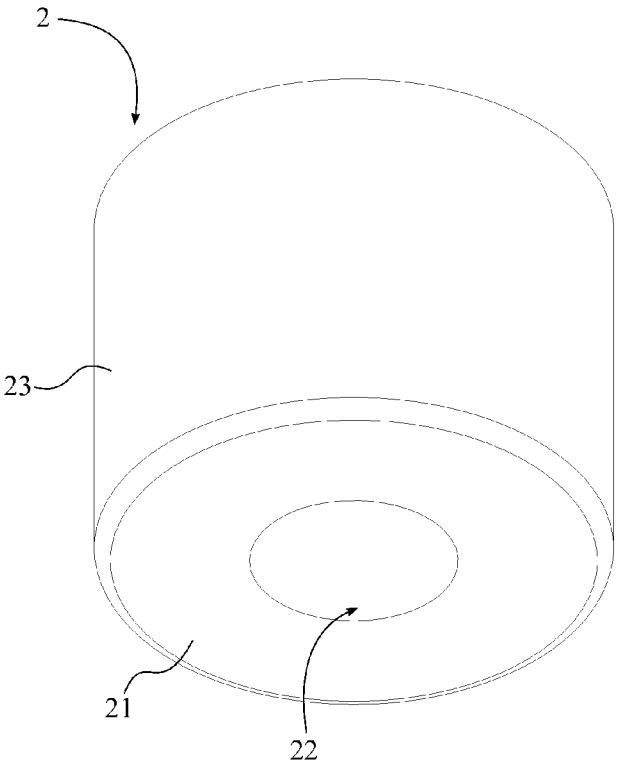
FIG. 10 is a bottom perspective view of the second container of the present invention.

In reference to FIG. 10 and FIG. 11, the second container 2, which generally stores baby formula, comprises a second-container base 21, an indentation 22, and a second lateral wall 23. The second lateral wall 23 is perimetrically connected around the second-container base 21 in such a way that the second lateral wall 23 is concentrically positioned with the second-container base 21. More specifically, the second-container base 21 and the second lateral wall 23 form a removable container so that baby formula can be stored within the second container 2. The indentation 22 is extended from the second-container base 21 and into the second container 2, where the indentation 22 is concentrically positioned with the second-container base 21 and internally positioned within the second lateral wall 23. The indentation 22 provides an enclosed cavity for the second container 2 so that the bottle cap 6 can be attached with the second container 2 when the bottle cap 6 is not attached around the liquid-flowing system 5. As a result, the users never have to worry about misplacing the bottle cap 6 when the infants or young children are fed through the present invention.

Figure 13:
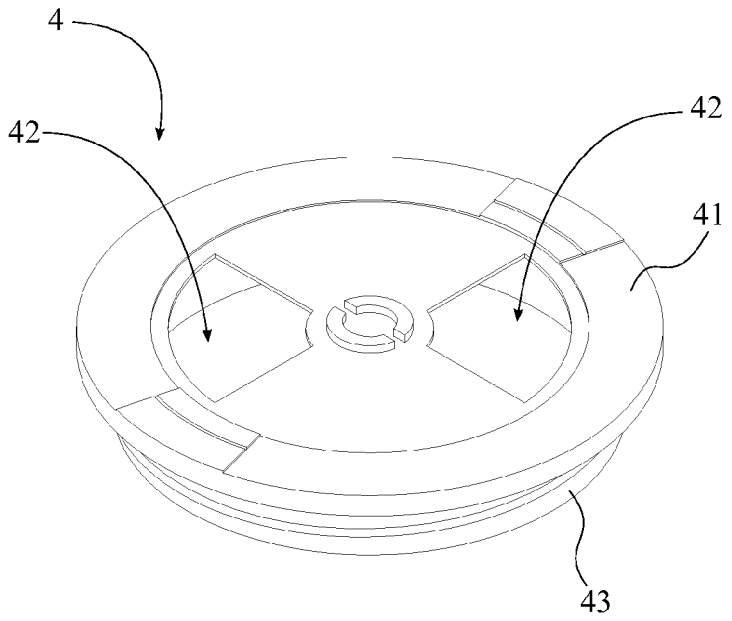
FIG. 13 is a perspective view of the connecting member of the present invention.
Figure 14:
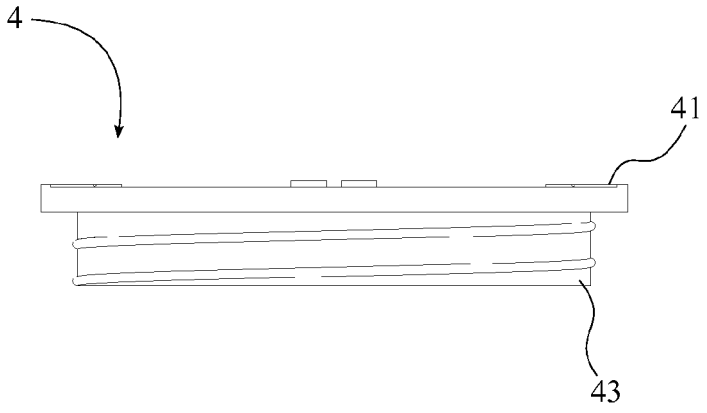
FIG. 14 is a side view of the connecting member of the present invention.

In reference to FIG. 13 and FIG. 14, the connecting member 4 that attaches both the first container 1 and the second container 2 together comprises a fastening plate 41, a plurality of third openings 42, and a fastening ring 43. More specifically, the fastening plate 41 is axially and concentrically connected with the fastening ring 43 as the plurality of third openings 42 traverses through the fastening plate 41. The diameter of the fastening ring 43 is determined with respect to the plurality of third openings 42 and the second container 2 so that the plurality of third openings 42 can be enclosed by the fastening ring 43 and the second container 2. The attachment between the first container 1 and the connecting member 4 is obtained through the fastening plate 41 and the first-container base 12 as the fastening plate 41 is concentrically attached with the first-container base 12 opposite of the top opening 11. Additionally, the plurality of third openings 42 aligns with the plurality of first openings 14 during the attachment between the first container 1 and the connecting member 4. Even though the fastening plate 41 for the preferred embodiment of the present invention utilizes a snap-fit fastening method to attach with the first-container base 12, the present invention can utilize any other type of attachment method in between the fastening plate 41 and the first-container base 12. The attachment between the second container 2 and the connecting member 4 is obtained through the fastening ring 43 and the second lateral wall 23 as the second lateral wall 23 is concentrically attached with the fastening ring 43 opposite of the second-container base 21. Even though the fastening ring 43 for the preferred embodiment of the present invention utilizes a threaded fastening method to attach with the second lateral wall 23, the present invention can utilize any other type of attachment method in between the fastening ring 43 and the second lateral wall 23.

Figure 12:
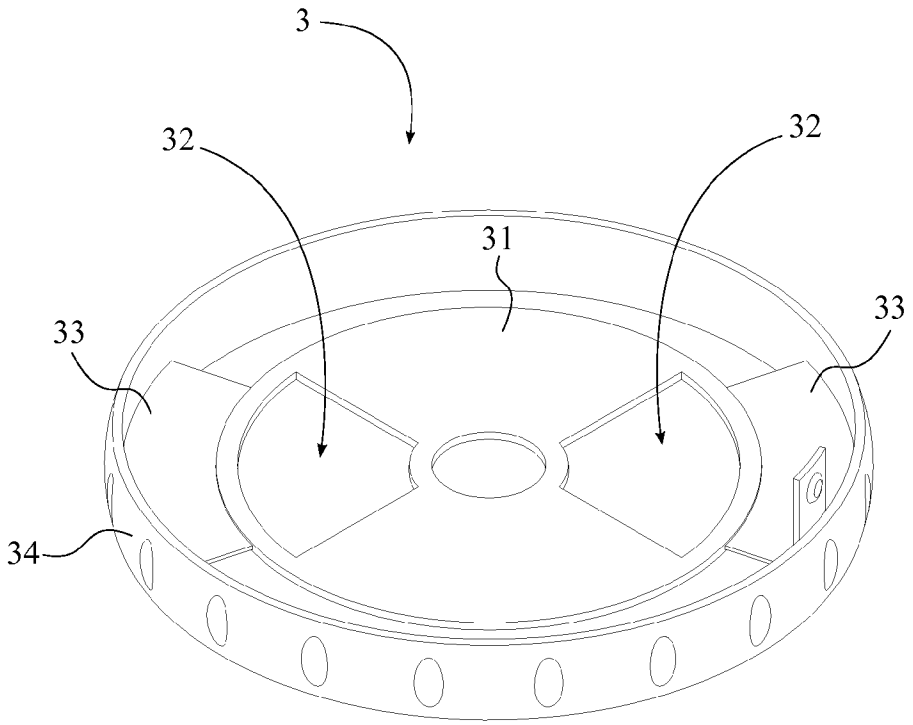
FIG. 12 is a perspective view of the release mechanism of the present invention.

In reference to FIG. 12, the release mechanism 3 allows the users to selectively operate the present invention in between the locked position and the unlocked position as the release mechanism 3 comprises an inner plate 31, a plurality of second openings 32, a pair of tabs 33, and an outer rim 34. The inner plate 31 is connected with the outer rim 34 by the pair of tabs 33 in such a way that the inner plate 31 is concentrically positioned within the outer rim 34 while the pair of tabs 33 is radially extended in between the inner plate 31 and the outer rim 34. The plurality of second openings 32 is traversed through the inner plate 31 so that the plurality of second openings 32 is able to align with the plurality of first openings 14 and the plurality of third openings 42. More specifically, the inner plate 31 and the pair of tabs 33 are positioned in between the first-container base 12 and the fastening plate 41 in such a way that the outer rim 34 is perimetrically and externally positioned around the first container 1 and the connecting member 4. The positioning of the release mechanism 3 allows the users to efficiently operate the release mechanism 3 in between the locked position and the unlocked position. The outer rim 34 is completed with a plurality of exterior recesses so that the users of the present invention are able to firmly grip the outer rim 34 during the usage of the outer rim 34.

Figure 20:
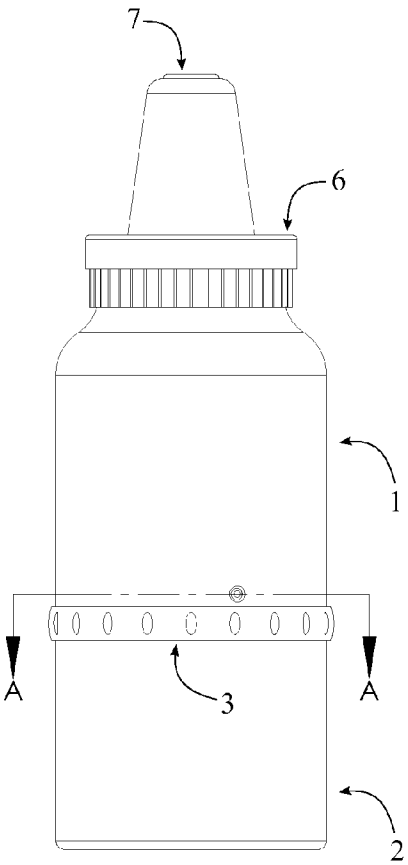
FIG. 20 is a side view for the locked position of the present invention, showing the plane upon which a cross sectional view is taken shown in FIG. 22.
Figure 22:
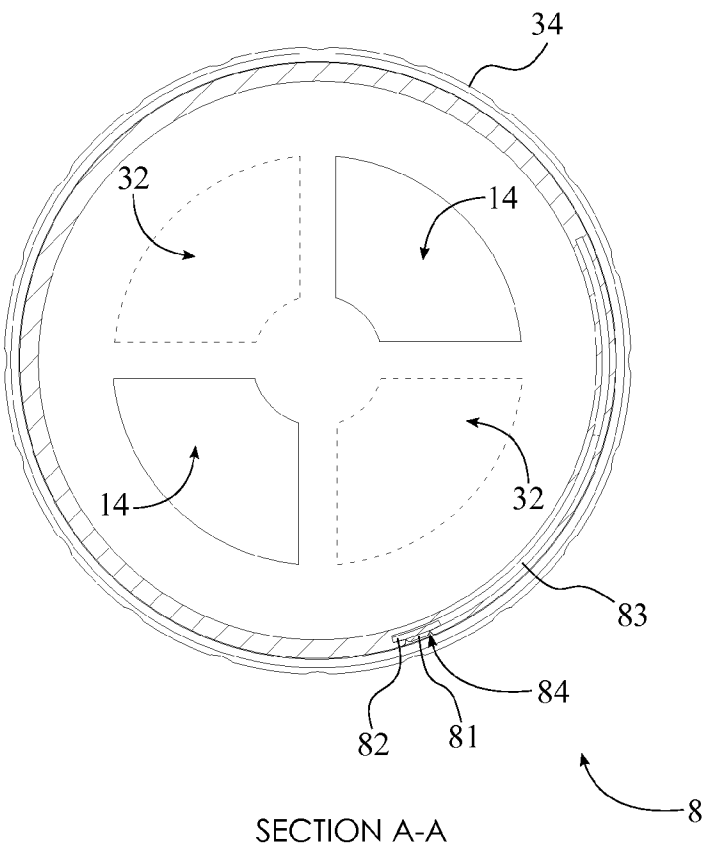
FIG. 22 is a cross section view for the locked position of the present invention taken along line A-A of FIG. 20.

In reference to FIG. 20 and FIG. 22, when the present invention is at the locked position, each of the plurality of second openings 32 is aligned in between each of the plurality of first openings 14. More specifically, the attachment between the first container 1 and the connecting member 4 linearly aligns each of the plurality of first openings 14 with each of the plurality of third openings 42, providing access in between the first container 1 and the second container 2. Since the release mechanism 3 is positioned in between the plurality of first openings 14 and the plurality of third openings 42, the locked position of the release mechanism 3 blocks the existing access in between the first container 1 and the second container 2 as each of the plurality of second openings 32 is positioned in between each of the plurality of first openings 14. As a result, baby formula and water can separately store within the present invention. Additionally, the safety locking mechanism 8 is engaged with the first container 1 in order to prevent accidental rotation of the release mechanism 3.

Figure 21:
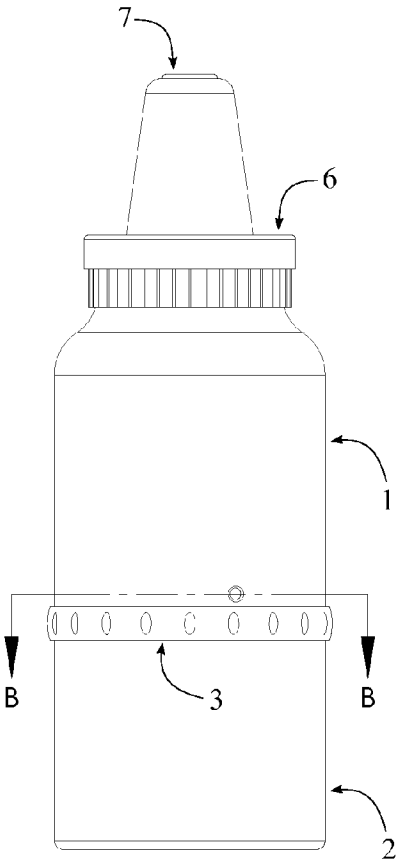
FIG. 21 is a side view for the unlocked position of the present invention, showing the plane upon which a cross sectional view is taken shown in FIG. 23.
Figure 23:
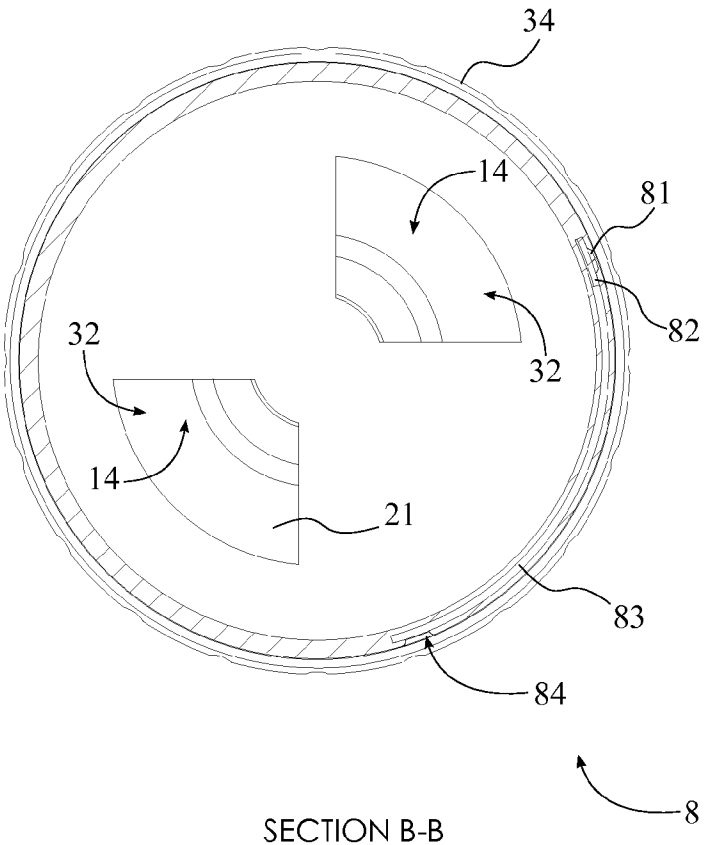
FIG. 23 is a cross section view for the unlocked position of the present invention taken along line B-B of FIG. 21.

In reference to FIG. 21 and FIG. 23, when the present invention is at the unlocked position, each of the plurality of second openings 32 is aligned with each of the plurality of first openings 14. More specifically, the attachment between the first container 1 and the connecting member 4 linearly aligns each of the plurality of first openings 14 with each of the plurality of third openings 42, providing access in between the first container 1 and the second container 2. Since the release mechanism 3 is positioned in between the plurality of first openings 14 and the plurality of third openings 42, the unlocked position of the release mechanism 3 is able to maintain the existing access in between the first container 1 and the second container 2 as each of the plurality of second openings 32 is linearly aligned with each of the plurality of first openings 14. As a result, baby formula and water can be mixed within the present invention. Additionally, the users have to disengage the safety locking mechanism 8 from the first container 1 in order to rotate the release mechanism 3 from the locked position to the unlocked position.

The safety locking mechanism 8 of the preferred embodiment of the present invention comprises a locking button 81, a guide tab 82, a guide rail 83, and a locking cavity 84. Since the safety locking mechanism 8 engages in between the first container 1 and the release mechanism 3, the locking button 81 and the guide tab 82 are positioned with respect to the release mechanism 3 while the guide rail 83 and the locking cavity 84 are positioned with respect to the first container 1. More specifically, the guide tab 82 is perpendicularly connected on a locking tab of the pair of tabs 33, and the locking button 81 is connected on the guide tab 82 and extends toward the outer rim 34. The guide rail 83 is traversed into the first lateral wall 13 from the first-container base 12 and radially extends within the first lateral wall 13. The radial distance of the guide rail 83 determines how far the release mechanism 3 can rotate in order to operate in between the locked position and the unlocked position. The locking cavity 84 externally traverses into the guide rail 83 through the first lateral wall 13 and adjacently positions with one of the extremities of the guide rail 83. Since the release mechanism 3 is concentrically positioned with the first container 1, the guide tab 82 is traversed into the guide rail 83 so that the locking button 81 is able to protrude outwardly through the locking cavity 84. Due to the positioning of the locking button 81 and the locking cavity 84, the safety locking mechanism 8 engages with the first container 1 and maintains within the locked position of the release mechanism 3 in order to avoid any kind of accidental rotation of the release mechanism 3. When the users need to rotate the release mechanism 3 from the locked position to the unlocked position, the users need to press the locking button 81 which subsequently presses the guide tab 82. Once the locking button 81 separates from the locking cavity 84, the users can rotate the release mechanism 3 as the guide tab 82 and the locking button 81 rotate along the guide rail 83. Once the guide tab 82 reaches the end of the guide rail 83, the release mechanism 3 is considered to be at the unlocked position as the release mechanism 3 stops rotating within the guide rail 83. Then the plurality of second openings 32 linearly aligns with the plurality of first openings 14 and the plurality of third openings 42 so that the users are able to mix baby formula and water within the present invention.

Figure 16:
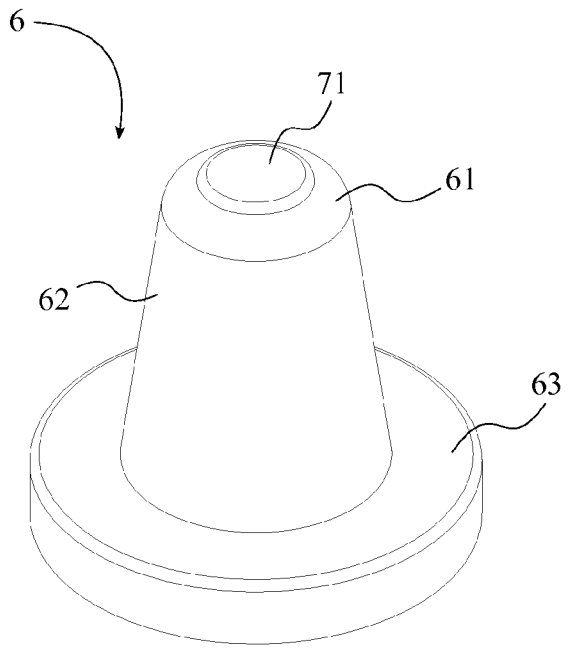
FIG. 16 is a perspective view of the bottle cap of the present invention.
Figure 17:
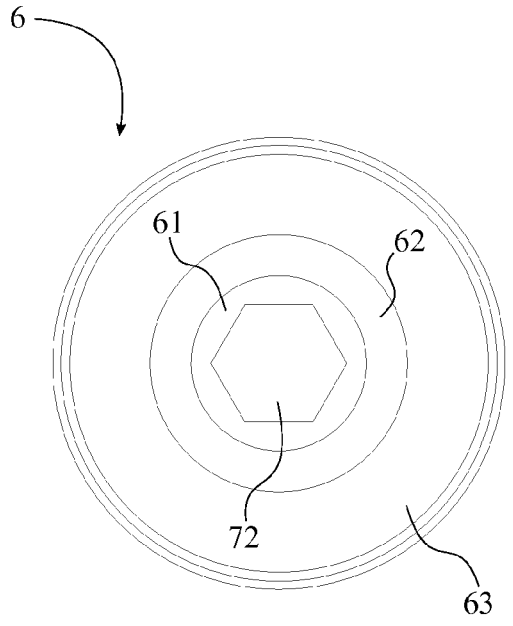
FIG. 17 is a bottom view of the bottle cap of the present invention.

In reference to FIG. 16 and FIG. 17, the bottle cap 6 comprises a top end portion 61, a nipple cover portion 62, and a base ring portion 63, where the nipple cover portion 62 is perimetrically connected around the top end portion 61 while the base ring portion 63 is perimetrically connected around the nipple cover portion 62 opposite of the top end portion 61. The lighting device 7 is adjacently connected within the top end portion 61 so that the lighting device 7 can be operated in between the on-position and the off-position. More specifically, the lighting device 7 comprises a push button light emitting diode (LED) switch 71 and a battery 72 as the push button LED switch 71 and the battery 72 are electrically connected by a circuitry. The push button LED switch 71 is externally positioned on the top end portion 61 while the battery 72 is internally positioned within the bottle cap 6 adjacent to the top end portion 61. The lighting device 7 of the present invention only lights up when the push button LED switch 71 is continuously pressed against a surface. In other words, the circuitry is completed with normally open contacts, where the normally open contacts are only closed through the continuous pressing of the push button LED switch 71. Additionally, the lighting device 7 is completed as waterproof unit to protect electrical components of the circuitry, the push button LED switch 71, and the battery 72.

Figure 4:
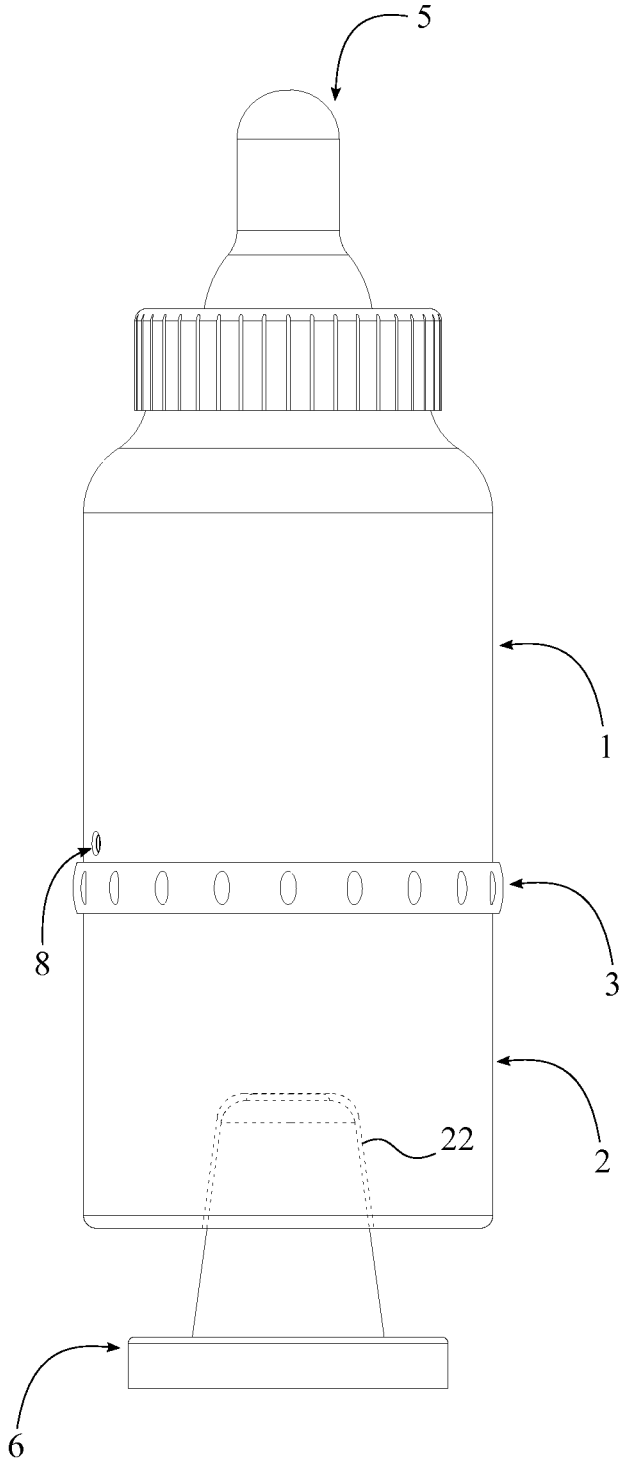
FIG. 4 is a side view of the present invention, wherein the bottle cap is attached to the indentation of the second container.
Figure 5:
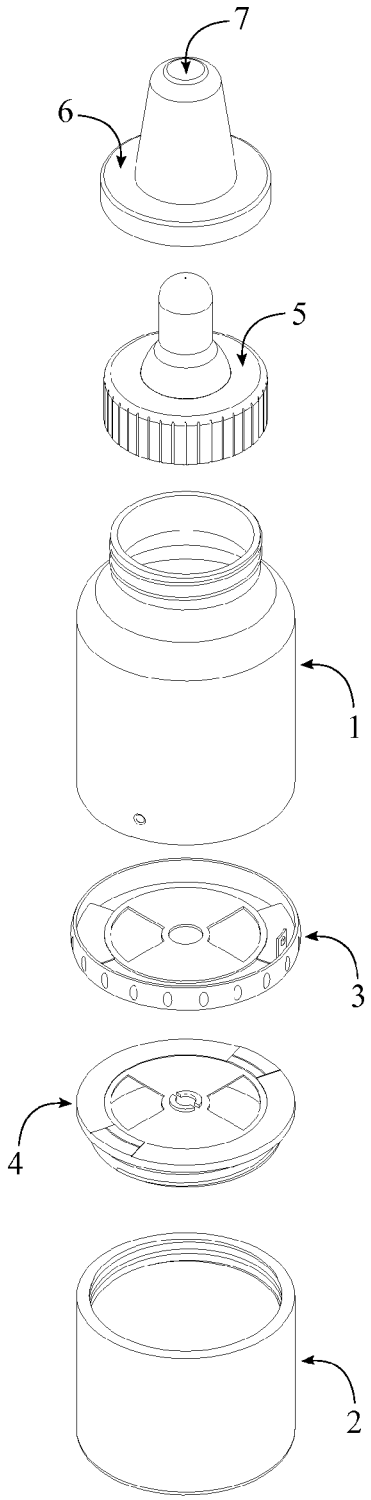
FIG. 5 is an exploded view of the present invention.
Figure 7:
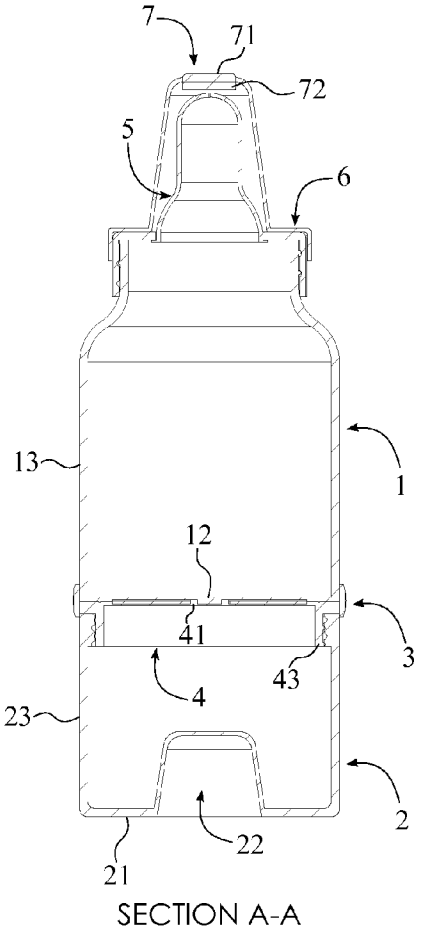
FIG. 7 is a cross section view of the present invention taken along line A-A of FIG. 6.
Figure 6:
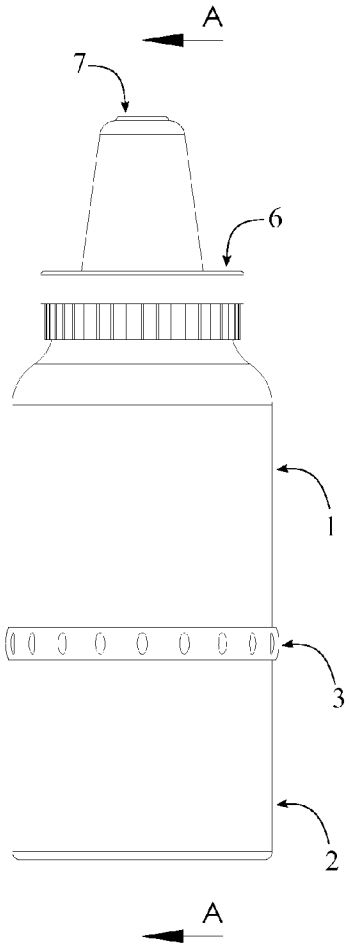
FIG. 6 is a side view of the present invention, showing the plane upon which a cross sectional view is taken shown in FIG. 7.
Figure 18:
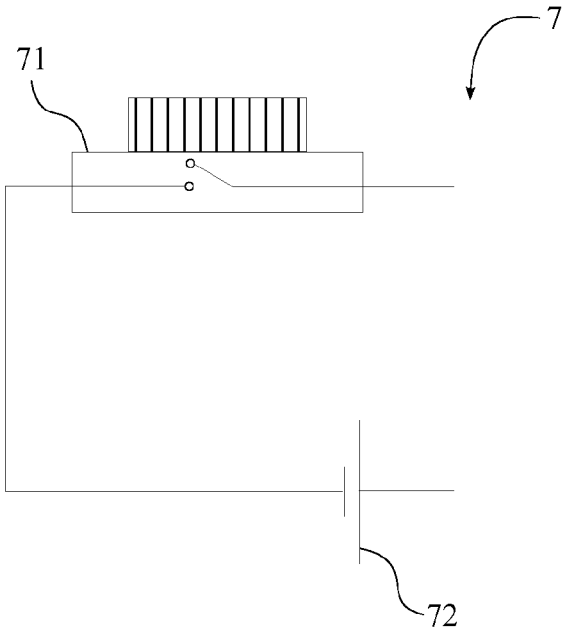
FIG. 18 is a basic electrical schematic showing the off-position of the lighting device of the present invention.
Figure 19:
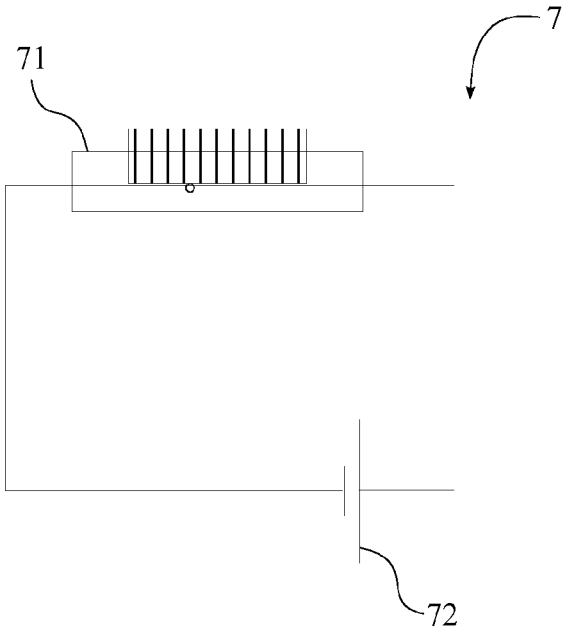
FIG. 19 is a basic electrical schematic showing the on-position of the lighting device of the present invention.

The bottle cap 6 can be configured with two different methods within the present invention, where each configuration is directly related with either the on-position or the off-position of the lighting device 7. As shown in FIG. 7 and FIG. 18, the first configuration of the bottle cap 6 that maintains the off-position of the lighting device 7, the bottle cap 6 needs to be adjacently position with the liquid-flowing system 5. More specifically, the top end portion 61 and the nipple cover portion 62 are adjacently positioned around the flexible nipple 52 as the base ring portion 63 attaches with the nipple collar ring 51. Since the push button LED switch 71 is not pressed against any kind of surface, the push button LED switch 71 extends from the bottle cap 6, maintaining the normally open contacts of the circuitry. Due to the fact circuitry is opened and electricity from the battery 72 does not flow into the push button LED switch 71, the lighting device 7 does not illuminate when the bottle cap 6 is attached to the liquid-flowing system 5. As shown in FIG. 4 and FIG. 19, the second configuration of the bottle cap 6 that maintains the on-position of the lighting device 7, the bottle cap 6 needs to be adjacently position with the second container 2. More specifically, the top end portion 61 and the nipple cover portion 62 are traversed into the indentation 22 as the top end portion 61 and the nipple cover portion 62 are internally attached within the indentation 22. Due to the attachment between the bottle cap 6 and the indentation 22, the push button LED switch 71 is continuously pressed against the indentation 22, closing the normally open contacts of the circuitry. Then the circuitry is able to flow electricity into the push button LED switch 71 from the battery 72, illuminating the lighting device 7. The lighting device 7 is then able to illuminate through the second container 2, the connecting member 4, the release mechanism 3, and the first container 1 as long as the push button LED switch 71 is continuously pressed against the indentation 22. When the lighting device 7 is illuminated through the present invention, the lighting device 7 helps the users to easily locate the mouth of the infants and the young children during night time so that the users can easily feed the infants and the young children without having to wake them up.

The present invention additionally comprises a thermal sleeve as an accessory component. The thermal sleeve is shaped similar to the first container 1 and the second container 2 so that the thermal sleeve is able to fully cover the present invention. When the first container 1 is filled with warm water, the thermal sleeve is able to minimize the heat lost of the present invention so that the elevated temperature of the warm water can be held for extended period of time. If the users of the present invention fill the first container 1 with warm water, the users do not have to warm up the baby formula mixture before feeding the infants or the young children as the thermal sleeve is able to retain the elevated temperature of the warm water.

The present invention easily separates into multiple components so that the present invention can be properly cleaned and sterilized. More specifically, the first container 1, the second container 2, the release mechanism 3, the connecting mechanism, the nipple collar ring 51, the flexible nipple 52, and the bottle cap 6 are easily separated into individual components for cleaning purpose of the present invention. Once the separated components are cleaned and sterilized, the users can easily assemble the separated components for the subsequent usages of the present invention.

Although the invention has been explained in relation to its preferred embodiment, it is to be understood that many other possible modifications and variations can be made without departing from the spirit and scope of the invention as hereinafter claimed.

What is claimed is:

1. An illuminating baby bottle with a removable container comprises:

a first container;

a second container;

a release mechanism;

a connecting member;

a liquid-flowing system;

a bottle cap;

a lighting device;

a safety locking mechanism;

the first container comprises a top opening, a first-container base, a first lateral wall, and a plurality of first openings;

the second container comprises a second-container base, an indentation, and a second lateral wall;

the release mechanism comprises a plurality of second openings;

the connecting member comprises a fastening plate, a plurality of third openings, and a fastening ring;

the first container being axially attached with the second container by the connecting member;

the release mechanism being axially positioned in between the first container and the connecting member, wherein the release mechanism selectively rotates in between a locked position and an unlocked position;

the liquid-flowing system being axially attached with the first container opposite of the release mechanism; and the lighting device being connected atop the bottle cap, wherein the lighting device selectively operates in between an on-position and an off-position.

2. The illuminating baby bottle with a removable container as claimed in claim 1 comprises:

the first lateral wall being perimetrically connected around the first-container base;

the top opening being oppositely positioned from the first-container base along the first lateral wall;

the top opening being concentrically positioned with the first-container base; and the plurality of first openings traversing through the first-container base.

3. The illuminating baby bottle with a removable container as claimed in claim 1 comprises:

the second lateral wall being perimetrically connected around the second-container base;

the second lateral wall being concentrically positioned with the second-container base;

the indentation being extended from the second-container base and into the second container; and the indentation being concentrically positioned with the second-container base and internally positioned within the second lateral wall.

4. The illuminating baby bottle with a removable container as claimed in claim 1 comprises:

the fastening plate being axially and concentrically connected with the fastening ring;

the plurality of third openings traversing through the fastening plate; and the fastening ring being positioned around the plurality of third openings.

5. The illuminating baby bottle with a removable container as claimed in claim 1 comprises:

the release mechanism further comprises an inner plate, a pair of tabs, and an outer rim;

the inner plate being connected with the outer rim by the pair of tabs;

the inner plate being concentrically positioned within the outer rim;

the pair of tabs being radially extended in between the inner plate and the outer rim; and the plurality of second openings traversing through the inner plate.

6. The illuminating baby bottle with a removable container as claimed in claim 1 comprises:

the fastening plate being concentrically attached with the first-container base opposite of the top opening;

the plurality of third openings being aligned with the plurality of first openings; and the fastening ring being concentrically attached within the second lateral wall opposite of the second-container base.

7. The illuminating baby bottle with a removable container as claimed in claim 1 comprises:

the inner plate and the pair of tabs being positioned in between the first-container base and the fastening plate; and the outer rim being perimetrically and externally positioned around the first container and the connecting member.

8. The illuminating baby bottle with a removable container as claimed in claim 7 comprises:

the locked position;

each of the plurality of second openings being aligned in between each of the plurality of first openings; and the safety locking mechanism being engaged with the first container.

9. The illuminating baby bottle with a removable container as claimed in claim 7 comprises:

the unlocked position;

each of the plurality of second openings being aligned with each of the plurality of first openings; and the safety locking mechanism being disengaged from the first container.

10. The illuminating baby bottle with a removable container as claimed in claim 1 comprises:

the liquid-flowing system comprises a nipple collar ring and a flexible nipple;

the nipple collar ring being adjacently and concentrically attached with the flexible nipple; and the nipple collar ring being concentrically attached around the top opening.

11. The illuminating baby bottle with a removable container as claimed in claim 1 comprises:

the bottle cap comprises a top end portion, a nipple cover portion, and a base ring portion;

the nipple cover portion being perimetrically connected around the top end portion;

the base ring portion being perimetrically connected around the nipple cover portion opposite of the top end portion; and the lighting device being adjacently connected within the top end portion.

12. The illuminating baby bottle with a removable container as claimed in claim 11 comprises:

the lighting device comprises a push button light emitting diode (LED) switch and a battery;

the push button LED switch being externally positioned on the top end portion;

the battery being internally positioned within the bottle cap adjacent to the top end portion; and the push button LED switch being electrically connected with the battery by a circuitry.

13. The illuminating baby bottle with a removable container as claimed in claim 12 comprises:

the on-position;

the top end portion and the nipple cover portion traversing into the indentation; and the push button LED switch being pressed into the bottle cap and illuminated through the second container, the connecting member, the release mechanism, and the first container, wherein the push button LED switch closes the circuitry.

14. The illuminating baby bottle with a removable container as claimed in claim 12 comprises:

the off-position;

the top end portion and the nipple cover portion being adjacently positioned around the flexible nipple; and the push button LED switch being extended from the bottle cap and not illuminated, wherein the push button LED switch opens the circuitry.

15. An illuminating baby bottle with a removable container comprises:

a first container;

a second container;

a release mechanism;

a connecting member;

a liquid-flowing system;

a bottle cap;

a lighting device;

a safety locking mechanism;

the first container comprises a top opening, a first-container base, a first lateral wall, and a plurality of first openings;

the second container comprises a second-container base, an indentation, and a second lateral wall;

the release mechanism further comprises a plurality of second openings, an inner plate, a pair of tabs, and an outer rim;

the connecting member comprises a fastening plate, a plurality of third openings, and a fastening ring;

the bottle cap comprises a top end portion, a nipple cover portion, and a base ring portion;

the lighting device comprises a push button light emitting diode (LED) switch and a battery;

the first container being axially attached with the second container by the connecting member;

the release mechanism being axially positioned in between the first container and the connecting member, wherein the release mechanism selectively rotates in between a locked position and an unlocked position;

the liquid-flowing system being axially attached with the first container opposite of the release mechanism;

the nipple cover portion being perimetrically connected around the top end portion;

the base ring portion being perimetrically connected around the nipple cover portion opposite of the top end portion;

the push button LED switch being externally positioned on the top end portion;

the battery being internally positioned within the bottle cap adjacent to the top end portion;

the push button LED switch being electrically connected with the battery by a circuitry; and the lighting device being connected atop the bottle cap, wherein the lighting device selectively operates in between an on-position and an off-position.

16. The illuminating baby bottle with a removable container as claimed in claim 15 comprises:

the first lateral wall being perimetrically connected around the first-container base;

the top opening being oppositely positioned from the first-container base along the first lateral wall;

the top opening being concentrically positioned with the first-container base;

the plurality of first openings traversing through the first-container base;

the second lateral wall being perimetrically connected around the second-container base;

the second lateral wall being concentrically positioned with the second-container base;

the indentation being extended from the second-container base and into the second container; and the indentation being concentrically positioned with the second-container base and internally positioned within the second lateral wall.

17. The illuminating baby bottle with a removable container as claimed in claim 15 comprises:

the fastening plate being axially and concentrically connected with the fastening ring;

the plurality of third openings traversing through the fastening plate;

the fastening ring being positioned around the plurality of third openings;

the inner plate being connected with the outer rim by the pair of tabs;

the inner plate being concentrically positioned within the outer rim;

the pair of tabs being radially extended in between the inner plate and the outer rim; and the plurality of second openings traversing through the inner plate.

18. The illuminating baby bottle with a removable container as claimed in claim 15 comprises:

the fastening plate being concentrically attached with the first-container base opposite of the top opening;

the plurality of third openings being aligned with the plurality of first openings;

the fastening ring being concentrically attached within the second lateral wall opposite of the second-container base;

the inner plate and the pair of tabs being positioned in between the first-container base and the fastening plate;

the outer rim being perimetrically and externally positioned around the first container and the connecting member;

the liquid-flowing system comprises a nipple collar ring and a flexible nipple;

the nipple collar ring being adjacently and concentrically attached with the flexible nipple; and the nipple collar ring being concentrically attached around the top opening.

19. The illuminating baby bottle with a removable container as claimed in claim 15 comprises:

the locked position;

each of the plurality of second openings being aligned in between each of the plurality of first openings;

the safety locking mechanism being engaged with the first container;

the off-position;

the top end portion and the nipple cover portion being adjacently positioned around the flexible nipple; and the push button LED switch being extended from the bottle cap and not illuminated, wherein the push button LED switch opens the circuitry.

20. The illuminating baby bottle with a removable container as claimed in claim 15 comprises:

the unlocked position;

each of the plurality of second openings being aligned with each of the plurality of first openings;

the safety locking mechanism being disengaged from the first container;

the on-position;

the top end portion and the nipple cover portion traversing into the indentation; and the push button LED switch being pressed into the bottle cap and illuminated through the second container, the connecting member, the release mechanism, and the first container, wherein the push button LED switch closes the circuitry.

* * * * *